United States Patent [19]

Shima et al.

[11] Patent Number: 4,957,548

[45] Date of Patent: Sep. 18, 1990

[54] CERMET ALLOY

[75] Inventors: Nobuhiko Shima, Narita; Hisaaki Ida, Kumagaya; Yusuke Iyori, Fukaya, all of Japan

[73] Assignee: Hitachi Metals, Ltd., Tokyo, Japan

[21] Appl. No.: 222,780

[22] Filed: Jul. 22, 1988

[30] Foreign Application Priority Data

Jul. 23, 1987 [JP] Japan ..... 62-183880

[51] Int. Cl.[5] ..... C22C 29/04

[52] U.S. Cl. ..... 75/238; 75/240; 75/241; 75/244; 419/13; 419/16; 419/17

[58] Field of Search ..... 75/244, 238, 240, 241; 419/16, 13, 17

[56] References Cited

U.S. PATENT DOCUMENTS

| | | | |
|---|---|---|---|
| 3,971,656 | 7/1976 | Rudy | 75/203 |
| 4,049,876 | 9/1977 | Yamamoto et al. | 428/932 |
| 4,150,984 | 4/1979 | Tanaka et al. | 75/238 |
| 4,636,252 | 1/1987 | Yoshimura et al. | 75/238 |
| 4,769,070 | 9/1988 | Tobioka et al. | 75/238 |
| 4,857,108 | 8/1989 | Brandt et al. | 75/238 |

FOREIGN PATENT DOCUMENTS

| | | |
|---|---|---|
| 3100926 | 8/1982 | Fed. Rep. of Germany . |
| 3418403 | 11/1984 | Fed. Rep. of Germany . |
| 76848 | 12/1984 | Japan . |
| 199048 | 9/1986 | Japan . |

OTHER PUBLICATIONS

Patent Abstracts of Japan, vol. 8, No. 184, (C-239) [1621], 23rd, Aug., 1984, & JP-A-5,976,848 (Mitsubishi Kinzoku K. K.) 02-05-1984.

*Primary Examiner*—Stephen J. Lechert, Jr.
*Assistant Examiner*—Nina Bhat
*Attorney, Agent, or Firm*—Antonelli, Terry, Stout & Kraus

[57] ABSTRACT

This invention provides a cermet alloy improved in toughness high-temperature strength and chipping resistance. This cermet alloy consists essentially of 50–95% by weight of a hard phase of a composite carbo-nitride of at least both of W and Ti and, optionally, one or more elements selected from the group consisting of Groups 4a, 5a and 6a elements of the periodic table, the balance being a binding phase, of an Fe family element or elements and inevitable impurities, said composite carbo-nitride has a rim-and-core structure which comprises a core portion of a composite carbo-nitride poor in Ti and nitrogen, surrounded thereon by a rim portion of a composite carbo-nitride rich in Ti and nitrogen. It is preferred that the hard phase consists of 50% by volume or less of TiN or TiCN particles having $N \geqq C$ and forming no rim-and-core structure and the composite carbo-nitride having the rim-and-core structure.

4 Claims, No Drawings

CERMET ALLOY

BACKGROUND OF THE INVENTION

This invention relates to a cermet alloy superior in toughness, chipping resistance and high-temperature strength.

Hitherto, components such as $Mo_2C$, WC, TaC and NbC have been added to cermet alloys in order to improve wetting between a metal binding phase and TiC particles or TiCN particles which are main components of cermet alloys. These additive components surround TiC or TiCN particles through dissolution into binding phase and precipitation onto TiC or TiCN particles during sintering to form a rim portion, and in a cermet with a binding metal phase, generally the composite carbo-nitride has a rim-and-core structure, but the central portion, i.e., core portion is rich in Ti and nitrogen and then, the rim portion is rich in wetting improving components such as WC, TaC, $Mo_2C$ and NbC and poor in Ti and nitrogen.

Formation of the rim portion improves wetting between the TiC or TiCN particles and metal binding phase, resulting in improvement in toughness, but with formation of the rim portion, particles of the composite carbo-nitride grow and they come to contact with each other. This portion where the composite carbo-nitride particles in contact with each other becomes a source for generation of micro-cracks or is apt to cleave as a path for propagation of cracks upon application of external stress, whereby chipping resistance is deteriorated. When the amount of the components which form the rim portion is decreased, toughness and high-temperature strength are deteriorated and overall characteristics are deteriorated. Thus, at present, addition of the rim portion forming components in more than a certain amount cannot be avoided.

SUMMARY OF THE INVENTION

As explained above, formation of the rim portion has both merits and demerits.

Accordingly, the object of this invention is to provide a cermet alloy improved in chipping resisntace without causing deterioration in toughness and high-temperature strength by adding components such as, for example, WC, TaC, NbC and $Mo_2C$ which are toughness-and high-temperature strength-improving components and rim portion-forming components in such an amount as necessary to provide improvement in toughness and high-temperature resisntace and simultaneously by reducing the amount of the rim portion to markedly decrease the portion where composite carbo-nitride particles contact each other.

DESCRIPTION OF THE INVENTION

As a result of the inventors' studies to solve the above problems, it has been found that the desired characteristics can be obtained by adding TiN or TiCN and a metal powder for binding phase to a composite carbo-nitride of one or more of the elements of Groups 4a, 5a and 6a of the periodic table including essentially W and Ti as a starting material, and sintering the mixture.

That is, this invention is a cermet alloy which consists essentially of 50–95% by weight of a hard phase of a composite carbon-nitride of at least both of W and Ti and, optionally, one or more elements selected from the group consisting of Groups 4a, 5a and 6a elements of the periodic table, the balance being a binding phase of an Fe family element or elements and inevitable impurities, said composite carbo-nitride has a rim-and-core structure which comprises a core portion of a composite carbo-nitride poor in Ti and nitrogen, surrounded thereon by a rim portion of a composite carbo-nitride rich in Ti and nitrogen. In one preferable embodiment of this invention, said hard phase consists of 50% by volumes or less of TiN or TiCN particles having $N \geqq C$ and forming no rim-and-core structure and said composite carbo-nitride forming the rim-and-core structure.

Since the composition of the composite carbo-nitride of W and Ti and, optionally, one or more elements selected from the group consisting of Groups 4a, 5a and 6a elements of the periodic table, as a starting material, is relatively close to the composition of the above-mentioned rim portion, wetting with the metal binding phase is good and improvement of toughness is possible. Besides, since the carbo-nitride components of W and the elements which are rim portion-forming components are contained in the starting material, relatively less rim portion is formed. However, when the composite carbo-nitride starting material is used alone, the Ostwald growth continuously occurs, namely, the components dissolved in the binding metal phase during sintering are precipitated in the existing composite carbo-nitride starting material and there are relatively many portions where the composite carbo-nitride particles contact each other due to the growth of grains of the composite carbo-nitride, and desired chipping resistance can be obtained. However, the inventors have made further studies to attain further improvement and have found that further improvement can be attained by external addition of TiCN or TiN which has $N \geqq C$. That is, TiCN and TiN are thermodynamically unstable at high temperatures and extremely unstable especially in the presence of carbon source. Therefore, there occur continuously the stages of TiCN or TiN being decomposed and preferentially dissolving in the binding metal phase and subsequently in the existing composite carbo-nitride particles as solid solution. In this way, Ti and N are preferentially dissolved in the binding metal phase as solid solution and, as a result, the dissolution of $Mo_2C$, TaC, NbC and the like which are contained in the composite carbo-nitride starting material and which are components for formation of the rim portion in the binding metal phase as solid solution is repressed, resulting in reduction of amount of the rim portion formed and decrease in the portions where the composite carbo-nitride particles per se contact each other. The new fact found in these studies is that when Ti and N dissolved in the binding metal phase dissolving into the existing composite carbo-nitride, W contained in the composite carbo-nitride and having no affinity for N is expelled from the composite carbo-nitride and dissolves into the binding metal phase to impart heat resistance to the binding metal phase.

By the above-mentioned effects, remarkable improvements in chipping resistance and heat resistance have become possible by decrease in the portions where particles per se contact each other without any deterioration of toughness of conventional cermets. Thus, the structure of the cermet alloy of this invention is such that the composite carbo-nitride particles have a rim-and-core structure and the distribution of the composition comprises the central portion, i.e., core portion rich in W and poor in Ti and nitrogen and the rim portion rich in Ti and nitrogen.

As explained above, TiCN or TiN particles continuously dissolve into the binding metal phase during sintering and it is further desirable to complete the sintering in non-equilibrium condition before complete dissolution of these TiCN or TiN particles whereby TiCN or TiN particles having N≧C in the course of dissolution into the binding metal phase are retained singly in alloy composition. That is, the contact of composite carbo-nitride particles per se caused by growth of the particles can be repressed by the presence of TiCN or TiN particles alone different in components from the carbo-nitride particles between the composite carbo-nitride particles which are continuously growing during sintering and further improvement of chipping resistance can be expected. In this case, unless N–C, less N is diffused and dissolved in the composite carbo-nitride and amount of the expelled W is small and thus TiCN or TiN particles are not effective to strengthen the binding phase by dissolution thereof into this phase. If the particles are rich in C, TiCN is relatively stable and the rim portion is formed around this particles as the core portion and the growth of the particles occur resulting in increase of the portion where the composite carbo-nitride particles per se contact each other to cause deterioration of toughness.

In this invention, TiN and/or TiCN are added, but TiNO or TiCNO may also be incorporated. TiNO or TiCNO may be positively added but they may be naturally partially contained in TiN and TiCN as starting materials.

Reasons for the numerical limitations are explained below.

If the composite carbon-nitride as a hard phase is contained in an amount of more than 95%, the toughness of the alloy is extremely deteriorated and if it is contained in an amount of less than 50%, the desired heat resistance and wear resistance cannot be obtained. Thus, 50–95% by weight is necessary. Further, if the content of TiCN or TiN particles alone is more than 50% by volume, the TiCN or TiN particles are inferior in wetting with binding metal phase and toughness of alloy is deteriorated.

This invention is explained by the following examples.

EXAMPLE 1

A starting composite carbo-nitride was prepared in the following manner. That is, WC powders having an average particle size of 10 μm, $TiC_{0.6}$ powders having an average particle size of 1.2 μm, TaC powders having an average particle size of 1.1 μm, NbC powders having an average particle size of 1.2 μm, $Mo_2C$ powders having an average particle size of 1.0 μm, VC powders having an average particle size of 1.5 μm, ZrC powders having an average particle size of 1.2 μm and HfC powders having an average particle size of 1.3 μm which were all commercially available where chosen and weighed so that the desired composition of composite carbo-nitride as shown in Table 1 was obtained and were wet-mixed. Then, the resulting miture was treated at 1800° C. under an $N_2$ partial pressure of not higher than 20 Torr for 1 hour to obtain a solid solution. Then, this was water-ground by an attritor to obtain a starting acid solution. Thus, there were obtained composite carbo-nitride starting materials (A)–(H) shown in Table 1 (1) for production of the alloys of this invention. Using these composite carbo-nitrides, cermet alloys (A)–(H) were prepared based on the blending ratios as shown in Table 1 (1) and properties of the alloys were measured. The results are shown in Table 1 (2). For comparative alloys, commercially available TiCN powders, (TiTa)CN powders and (TiW)CN powders were used as they were and single addition of TiCN was not effected. As shown in Table 1 (2), in the alloys of this invention, contacting ratio of the composite carbo-nitride (contacting area of composite carbo-nitride per se/entire surface area of composite carbo-nitride) was able to be decreased owing to reduction of amount of the rim portion and spheroidization of composite carbo-nitride particles and thus increase in crack resistance was recognized.

The crack resistance is a value obtained by dividing Vickers load by length of crack produced from Vickers dent and indicates that load necessary for formation of cracks of 1 mm. This is a parameter which correlates with breaking toughness $K_{1c}$. The high-temperature hardness was measured according to three-point bending test by applying a stress of 70 kg/mm$^2$ at 950° C. The smaller the creep strain rate is, the longer the time required for breaking is. The alloys of this invention had a conspiciously high strength at high temperatures as a result of expelling of W into the binding phase due to dissolution of N into the composite carbo-nitride starting material and as a result of strengthening of the binding phase due to formation of solid solution.

Table 2 shows the results of cutting test on the alloys (A)–(H) of this invention and the comparative alloys (1)–(4).

The chipping formation rate is a percentage length of chipping/total length of cutting edge×100 when JIS-SKD61 (HRC 44) was cut under wetting condition according to end-milling working of 10 mm width for 10 minutes with a depth of cutting of 10 mm, width of cutting of 2 mm, a peripheral speed of 28 m/min and feeding for one edge of 0.05 mm. The alloys of this invention were markedly superior in chipping resistance because of a low degree of contacting of composite carbo-nitride per se. The tool life is indicated by time required for expiration of life when the expiration of life is defined to be 0.3 mm in maximum wear of flank in turning work of SCM440 (HRC34) by the alloys at cutting speeds of 100 m/min and 250 m/min with a feed of 0.3 mm per one revolution. Significant difference were not recognized with a cutting speed of 100 m/min, but the alloys of this invention showed very long tool life with cutting at 250 m/min. In the case of the comparative alloys, the cutting edge showed plastic deformation and thus the life was short. On the other hand, the alloys of this invention were high in high-temperature strength and no plastic deformation occurred at cutting edge.

TABLE 1

| | | Composite carbo-nitride | Blending ratio | Hardness (HRA) | Crack resistance (kg/mm) | Folding endurance (kg/mm$^2$) | High temperature creep Breaking time | Contacting ratio |
|---|---|---|---|---|---|---|---|---|
| Alloys | A | $(Ti_{0.4}W_{0.3}Nb_{0.2}Mo_{0.1})C_{0.9}N_{0.1}$ | 70A + 15$TiC_{0.4}N_{0.6}$ + 7.5Co,7.5Ni | 91.0 | 78 | 175 | 65 | 0.15 |

TABLE 1-continued

| | | Composite carbo-nitride | Blending ratio | Hardness (HRA) | Crack resistance (kg/mm) | Folding endurance (kg/mm$^2$) | High temperature creep Breaking time | Contacting ratio |
|---|---|---|---|---|---|---|---|---|
| of this invention | B | $(Ti_{0.4}W_{0.3}Nb_{0.2}Ta_{0.1})C_{0.9}N_{0.1}$ | 70B + 15$TiC_{0.4}N_{0.6}$ + 7.5Co,7.5 Ni | 90.8 | 85 | 185 | 60 | 0.18 |
| | C | $(Ti_{0.4}W_{0.3}Mo_{0.3})C_{0.9}N_{0.1}$ | 70C + 15$TiC_{0.4}N_{0.6}$ + 7.5Co,7.5Ni | 90.8 | 86 | 184 | 75 | 0.14 |
| | D | $(Ti_{0.4}W_{0.3}Nb_{0.2}Mo_{0.1})C_{0.95}N_{0.05}$ | 70D + 15TiN + 7.5Co,7.5Ni | 90.9 | 80 | 170 | 62 | 0.13 |
| | E | $(Ti_{0.4}W_{0.4}Ta_{0.2})C_{0.9}N_{0.1}$ | 65E + 15$TiC_{0.4}N_{0.6}$ + 5$Mo_2C$ + 7.5Co 7.5Ni | 91.5 | 75 | 183 | 95 | 0.20 |
| | F | $(Ti_{0.4}W_{0.3}Ho_{0.2})C_{0.9}N_{0.1}$ | 60F + 15$TiC_{0.4}N_{0.6}$ + 5TaC + 5NbC + 7.5Co 7.5Ni | 91.4 | 75 | 190 | 86 | 0.19 |
| | G | $(Ti_{0.3}W_{0.4}Mo_{0.2}Ta_{0.1})C_{0.9}N_{0.1}$ | 70A + 15$TiC_{0.4}N_{0.6}$ + 7.5Co,7.5Ni | 91.1 | 83 | 176 | 95 | 0.14 |
| | H | $(Ti_{0.4}W_{0.3}Nb_{0.1}Ta_{0.2})C_{0.8}N_{0.2}$ | 70H + 15$TiC_{0.4}N_{0.6}$ + 7.5Co + 7.5Ni | 91.3 | 80 | 188 | 99 | 0.14 |
| Comparative alloys | 1 | Commercially available TiCN | 43$TiC_{0.7}N_{0.3}$ + 21WC + 14NbC + | 91.5 | 60 | 180 | 23 | 0.31 |
| | 2 | Commercially available TiCN $(Ti_{0.6}Ta_{0.4})C_{0.9}N_{0.1}$ | 7$Mo_2C$ + 7.5Co + 7.5Ni | 91.4 | 58 | 152 | 25 | 0.35 |
| | 3 | Commercially available TiCN $(Ti_{0.5}W_{0.5})C_{0.9}N_{0.1}$ | | 91.5 | 61 | 158 | 28 | 0.30 |
| | 4 | $(Ti_{0.4}W_{0.3}Mo_{0.3})C_{0.9}N_{0.3}$ | 70(4) + 15$TiC_{0.7}N_{0.3}$ + 7.5Co 7.5Ni | 90.9 | 70 | 165 | 38 | 0.25 |

TABLE 2

| | | Chipping formation rate (%) | Tool life (min) 100 m/min | Tool life (min) 250 m/min |
|---|---|---|---|---|
| Alloys of this invention | A | 4.2 | 25 | 18 |
| | B | 3.8 | 28 | 17 |
| | C | 4.7 | 30 | 16 |
| | D | 4.4 | 24 | 15 |
| | E | 4.4 | 27 | 16 |
| | F | 4.5 | 27 | 18 |
| | G | 2.9 | 28 | 15 |
| | H | 3.3 | 24 | 18 |
| Comparative alloys | 1 | 13.5 | 22 | 2 |
| | 2 | 18.8 | 23 | Broken off in 1 minute |
| | 3 | 20.5 | 20 | 1 |
| | 4 | 9.5 | 25 | 14 |

EXAMPLE 2

Alloys having a composition of 25TiCN-20WC20NbC-15TaC-5$Mo_2C$-7.5Co-7.5Ni and containing 2.0% of N and 7.7% of C were prepared according to (W,Ti,Nb,Ta,Mo)CN+TiCN+Co,Ni for this invention and (Ti,W)CN+NbC+TaC+$Mo_2C$+Co,Ni for comparative alloy. The alloys were evaluated in the same manner as in Example 1 and the results are shown in Table 3. Results of compositional analysis of rim-and-core structure by an analytical transmission electron microscope are shown in Tables 4 and 5. The alloy of this invention had superior characteristics as in Example 1 and besides, it had a layered structure comprising a central portion poor in Ti and N and rich in W and a rim portion rich in Ti and N. The content of N was qualitatively analyzed by the ratio Ti+N/Ti in Auger spectrum.

TABLE 3

| | Hardness (HRA) | Crack resistance | Folding endurance | High temperature creep Breaking time | Chipping formation rate | Tool life 100 m/min | Tool life 25 m/min | Contacting ratio |
|---|---|---|---|---|---|---|---|---|
| Alloys of this invention | 91.0 | 79 | 185 | 85 | 44 | 30 min | 18 min | 0.15 |
| Comparative alloy | 91.3 | 59 | 155 | 29 | 15.9 | 24 min | 1 min | 0.30 |

TABLE 4

| | Composition: Rim portion Ti | W | Nb | Ta | Mo | Central portion Ti | W | Nb | Ta | Mo |
|---|---|---|---|---|---|---|---|---|---|---|
| Alloy of this invention | 28.10 | 27.14 | 26.12 | 8.50 | 7.72 | 16.08 | 35.36 | 26.95 | 7.60 | 9.57 |
| Comparative alloy | 13.05 | 38.35 | 28.03 | 10.50 | | 33.10 | 24.11 | 24.90 | 4.85 | |

TABLE 5

| | Auger spectrum ratio (Ti + N/Ti) Rim portion | Central portion |
|---|---|---|
| Alloy of this invention | 1.78 | 1.40 |
| Comparative alloy | 1.48 | 1.88 |

EXAMPLE 3

Alloys (I) and (J) of this invention and comparative alloys (5) and (6) were prepared and evaluated in the same manner as in Example 1. Results of comparison are shown in Tables 6 and 7. As in Example 1, the alloys of this invention were superior in chipping resistance and high-temperature strength.

TABLE 6

| | | Composite carbo-nitride | Blending ratio |
|---|---|---|---|
| Alloys of this invention | I | $(Ti_{0.4}W_{0.3}Nb_{0.2}Mo_{0.08}V_{0.02})C_{0.9}N_{0.1}$ | 70I + $15TiC_{0.7}N_{0.3}$ + 7.5Co7.5Ni |
| | J | $(Ti_{0.4}W_{0.3}Nb_{0.2}Mo_{0.09}Zr_{0.01})C_{0.9}N_{0.1}$ | 65J + $15TiC_{0.7}N_{0.3}$ + 10Co10Ni |
| Comparative alloys | 5 | $TiC_{0.7}N_{0.3}$ | $TiC_{0.3}N_{0.7}$ + 21WC + 14NbC + $5.6Mo_2C$1.4VC + 7.5Co7.5Ni |
| | 6 | $TiC_{0.7}N_{0.3}$ | $TiC_{0.3}N_{0.7}$ + 20WC + 13NbC + $5.9Mo_2C$ + 0.65ZrC + 10Co10Ni |

TABLE 7

| | | Hardness | Crack resistance | Folding endurance | High temperature creep (breaking time) | Chipping formation rate | Tool life 100 m/min | Tool life 200 m/min |
|---|---|---|---|---|---|---|---|---|
| Alloys of this invention | I | 91.3 | 82 | 188 | 110 | 0.21 | 38 | 30 |
| | J | 90.1 | 103 | 215 | 80 | 0.15 | 63 | 48 |
| Comparative alloys | 5 | 91.6 | 55 | 145 | 29 | 0.35 | 15 | 2 |
| | 6 | 90.2 | 88 | 121 | 55 | 0.31 | 23 | 3 |

As is clear from the above explanation, improvements of chipping resistance and high-temperature resistance which have been impossible in the conventional cermet alloys become possible according to this invention. Thus, the cermet alloys of this invention can be used for end mill cutting, high speed cutting and cutting of high strength materials.

What is claimed is:

1. A cermet alloy which consists essentially of 50–95% by weight of a hard phase comprising a composite carbo-nitride of tungsten and titanium and one or more elements selected from the group consisting of Groups IVa, Va and VIa elements of the Periodic Table and the balance being a binding phase of an Fe family element or elements and inevitable impurities; said hard phase containing 50% by volume or less of TiN particles or TiCN particles having N≧C and forming no rim-and-core structure, and said composite carbo-nitride having a rim-and-core structure which comprises a core portion of the composite carbo-nitride poor in titanium and nitrogen, surrounded thereon by a rim portion of the composite carbo-nitride rich in titanium and nitrogen.

2. A cermet alloy according to claim 1, wherein the one or more elements selected from the group consisting of Groups IVa, Va and VIa elements of the Periodic Table are selected from the group consisting of Ti, Zr, Hf, V, Nb, Ta, Cr, Mo and W.

3. A cermet alloy according to claim 2, wherein said core portion of the composite carbo-nitride is rich in tungsten.

4. A method of producing a cermet alloy according to claim 1, which comprises mixing TiN or TiCN and a metal for the binding phase with a carbo-nitride of W and Ti and one or more elements selected from the group consisting of Groups IVa, V and VIa elements of the Periodic Table and then sintering the mixture.

* * * * *